United States Patent [19]

Burdette et al.

[11] 4,028,066

[45] June 7, 1977

[54] LOW VISCOSITY-HIGH FLASH POINT RAMJET AND TURBOJET FUELS

[75] Inventors: George W. Burdette; Dean H. Couch, both of China Lake, Calif.

[73] Assignee: The United States of America as represented by the Secretary of the Navy, Washington, D.C.

[22] Filed: Oct. 21, 1974

[21] Appl. No.: 516,068

[52] U.S. Cl. ..... 44/80
[51] Int. Cl.[2] ..... C10L 1/16
[58] Field of Search ..... 44/80; 208/15

[56] References Cited

UNITED STATES PATENTS

| | | | |
|---|---|---|---|
| 1,879,118 | 9/1932 | Davidson | 44/80 |
| 2,211,732 | 8/1940 | Sachanen et al. | 44/80 |
| 2,305,026 | 12/1942 | Munday | 44/80 |
| 2,749,225 | 6/1956 | Barnum et al. | 44/80 |
| 3,817,721 | 6/1974 | Perilstein | 44/80 |

*Primary Examiner*—Daniel E. Wyman
*Assistant Examiner*—Mrs. Y. Harris-Smith
*Attorney, Agent, or Firm*—R. S. Sciascia; Roy Miller; Lloyd E. K. Pohl

[57] ABSTRACT

A method for propelling a ramjet or turbojet engine wherein a fuel consisting essentially of a mixture of a fraction of petroleum distillate having a boiling point of from 380° F to 415° F and butylbenzene is used.

4 Claims, No Drawings

LOW VISCOSITY-HIGH FLASH POINT RAMJET AND TURBOJET FUELS

BACKGROUND OF THE INVENTION

1. Field of the Invention

This invention relates to a method for propelling a ramjet or turbojet engine.

2. Description of the Prior Art.

Ramjet and turbojet engines are well known and the process wherein fuel and air are mixed in a combustion chamber and burned to propel them is also well known. It is with improved fuels for use in this process that this invention is concerned.

In the past, the only fuels that have actually found much use in ramjet and turbojet propulsion are those fuels commonly known as JP-4 and JP-5. These fuels, in spite of the fact that they have served well for many years now, have certain drawbacks. JP-4 has drawback in that it has a high freezing point (about −40°) and varies considerable in composition from batch to batch.

Various other fuels have been proposed for use in lieu of JP-4 and/or JP-5 and, like JP-5, and JP-5, could serve well. However, these proposed fuels have drawbacks also-primarily high viscosities at low temperatures.

SUMMARY OF THE INVENTION

According to this invention, fuels consisting essentially of a mixture of petroleum distillate fraction which boils at from 380° F. to 415° F and butylbenzene are used in the process for propelling a ramjet or turbojet engine comprising the steps of mixing fuel and air in a combustion chamber and combusting the mixture.

DESCRIPTION OF THE PREFERRED EMBODIMENT

The petroleum distillate used in this invention may be obtained by distilling petroleum and collecting that fraction which boils at from 380° F to 415° F. Butylbenzenes are available commercially. They may also be prepared by the method described in U.S. Pat. No. 1,953,702 or by other well known methods.

According to this invention a mixture consisting essentially of about 80 weight percent of the above-described petroleum distillate and 20 weight percent of certain hereinafter specified butylbenzene isomers is used as the fuel. The petroleum distillate could be used alone but the addition of butylbenzene greatly enhances the properties of the fuel.

The following table compares certain important properties of the fuels of this invention with those of JP-4 and JP-5.

TABLE

| Fuel | Density | Flash Point | Viscoity | Freezing Point |
|---|---|---|---|---|
| | (20° ) | (° F) | (cp.) | (° F) |
| 80 wt % distillate/20 wt. % normal butylbenzene- | | | | |
| | 0.819 | 140 | 6.6 at −40° F<br>11.2 at −65° F | Below −65 |
| 80 wt % distillate/20 wt % iso-butylbenzene- | | | | |
| | 0.818 | 140 | 6.4 at −40° F<br>11.6 at −65° F | Below −65 |
| JP-4 | 0.75 to 0.80 | −20 to +20 | 5 at 65° F | −65 |
| JP-5 | 0.79 to 0.85 | 140 | 13 at −40° F | Freezes at about−40 |

It can be seen from the table that the fuels of this invention approximate the good points of either of the commonly used prior art fuels. The densities of all four fuels in the table are similar. The flash points of the fuels of this invention equal the desirable flash point of JP-5. The viscosities of the fuels of this invention, while they are somewhat higher than that of JP-4 at −65° F are certainly better than that of JP-5 at −65° F because JP-5 is frozen (has an infinite viscosity) at this point. And the fuels of this invention both freeze at temperatures below −65° F.

In the table, the term distillate means petroleum distillate boiling at from 380° F to 415° F. Fuels of this invention may be prepared by simply mixing the two components. The two components are completely miscible in one another.

The weight percentages of the two components have been specified as 80 and 20. However, some leeway is permissable. The properties of the fuel are more important than the weight percentages. That is, the 140° F flashpoint and the fact that the fuel is still liquid at −65° F are of more importance than the composition. Fuels having 80% ± 2 weight percent distillate and 20% ± 2 weight percent butylbenzene are still in the suitable area insofar as properties are concerned.

In addition to those properties listed in the table, the volumetric heating values of the fuels of this invention rival those of JP-4 and JP-5.

What is claimed is:

1. In the process for propelling a ramjet or turbojet engine wherein a fuel is injected into a combustion chamber, mixed with air and combusted, the improvement residing in utilizing, as the fuel, a mixture consisting essentially of 80 ± 2% petroleum distillate which boils at a temperature of from 380° F to 415° F and a balance butylbenzene, said mixture having a flashpoint of about 140° F and freezing at a temperature of lower than −65° F.

2. The process according to claim 1 wherein said mixture contains about 80 weight percent of said petroleum distillate and about 20 weight percent butylbenzene.

3. The process according to claim 2 wherein said butylbenzene is normal butylbenzene.

4. The process according to claim 2 wherein said butylbenzene is iso-butylbenzene.

* * * * *